US010448471B1

(12) United States Patent
Chowdhury et al.

(10) Patent No.: US 10,448,471 B1
(45) Date of Patent: Oct. 15, 2019

(54) LIGHTING SYSTEM WITH CONFIGURABLE DIMMING

(71) Applicant: ABL IP Holding LLC, Atlanta, GA (US)

(72) Inventors: Towfiq M. Chowdhury, Lake Forest, IL (US); Feng Chen, Hoffman Estates, IL (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/022,892

(22) Filed: Jun. 29, 2018

(51) Int. Cl.
*H05B 33/08* (2006.01)
*H05B 37/02* (2006.01)

(52) U.S. Cl.
CPC ..... *H05B 33/0845* (2013.01); *H05B 33/0857* (2013.01); *H05B 37/0272* (2013.01)

(58) Field of Classification Search
None
See application file for complete search history.

(56) References Cited

U.S. PATENT DOCUMENTS

| | | | |
|---|---|---|---|
| 6,995,355 | B2 | 2/2006 | Rains, Jr. et al. |
| 7,014,336 | B1 | 3/2006 | Ducharme et al. |
| 7,416,312 | B1 | 8/2008 | McDermott |
| 8,172,415 | B2 | 5/2012 | Wegh et al. |
| 8,203,260 | B2 | 6/2012 | Li et al. |
| 8,228,002 | B2 | 7/2012 | Newman, Jr. et al. |
| 8,317,362 | B2 | 11/2012 | Ku et al. |
| 8,436,549 | B2 | 5/2013 | Hasnain |
| 8,598,809 | B2 | 12/2013 | Negley et al. |
| 8,638,045 | B2 | 1/2014 | Kunst et al. |
| 8,710,754 | B2 | 4/2014 | Baddela et al. |
| 8,791,642 | B2 | 7/2014 | van de Ven et al. |
| 8,872,438 | B2 * | 10/2014 | Zhou ..... H05B 33/0845 315/193 |

(Continued)

FOREIGN PATENT DOCUMENTS

| | | |
|---|---|---|
| CN | 106555981 | 4/2017 |
| EP | 2768283 | 8/2014 |

(Continued)

OTHER PUBLICATIONS

U.S. Appl. No. 15/991,209, "Non Final Office Action," dated Sep. 7, 2018, 10 pages.

(Continued)

*Primary Examiner* — Jany Richardson
(74) *Attorney, Agent, or Firm* — Kilpatrick Townsend & Stockton LLP

(57) ABSTRACT

Certain aspects involve lighting systems in which a dimming curve of the illumination can be selectively modified. For instance, a lighting system includes a light source configured for emitting light at a target color temperature and a switch configured to receive a selection of a dimming curve from a predefined set of dimming curves. When in a first position, the switch configures the light source to adjust a lumen intensity of the light source according to a dimming adjustment signal and a first dimming curve. When in a second position, the switch configures the light source to adjust the lumen intensity according to a dimming adjustment signal and a second dimming curve that is different from the first dimming curve.

20 Claims, 5 Drawing Sheets

(56) References Cited

U.S. PATENT DOCUMENTS

| | | | | |
|---|---|---|---|---|
| 8,890,436 | B2 | 11/2014 | Chou | |
| 9,125,271 | B2 | 9/2015 | Martins et al. | |
| 9,210,760 | B2 | 12/2015 | Sanders et al. | |
| 9,277,607 | B2 | 3/2016 | Ramer et al. | |
| 9,289,269 | B2 | 3/2016 | Valteau et al. | |
| 9,414,457 | B2 | 8/2016 | Fukuda et al. | |
| 9,544,951 | B1 * | 1/2017 | O'Neil | H05B 33/0815 |
| 9,719,642 | B1 | 8/2017 | Macias | |
| 9,730,291 | B1 | 8/2017 | Janik et al. | |
| 9,820,350 | B2 | 11/2017 | Pyshos et al. | |
| 9,892,693 | B1 | 2/2018 | Kumar et al. | |
| 10,091,855 | B2 | 10/2018 | Van Winkle | |
| 10,117,300 | B2 | 10/2018 | Doheny et al. | |
| 10,163,405 | B2 | 12/2018 | Kumar et al. | |
| 2006/0220586 | A1 | 10/2006 | Latham | |
| 2006/0238136 | A1 | 10/2006 | Johnson, III et al. | |
| 2008/0130298 | A1 | 6/2008 | Negley et al. | |
| 2010/0141175 | A1 | 6/2010 | Hasnain et al. | |
| 2010/0207534 | A1 | 8/2010 | Dowling et al. | |
| 2011/0058372 | A1 | 3/2011 | Lerman et al. | |
| 2012/0242247 | A1 | 9/2012 | Hartmann et al. | |
| 2013/0038222 | A1 | 2/2013 | Yeh et al. | |
| 2013/0140988 | A1 | 6/2013 | Maxik et al. | |
| 2013/0200806 | A1 | 8/2013 | Chobot | |
| 2014/0035472 | A1 | 2/2014 | Raj et al. | |
| 2014/0210357 | A1 | 7/2014 | Yan et al. | |
| 2016/0363308 | A1 | 12/2016 | Shum | |
| 2016/0366746 | A1 | 12/2016 | van de Ven et al. | |
| 2017/0019973 | A1 | 1/2017 | Beck et al. | |
| 2017/0027033 | A1 | 1/2017 | Chobot et al. | |
| 2017/0086265 | A1 | 3/2017 | Akiyama et al. | |
| 2017/0086280 | A1 | 3/2017 | Boomgaarden et al. | |
| 2017/0135186 | A1 * | 5/2017 | O'Neil | H05B 37/0272 |
| 2017/0164440 | A1 * | 6/2017 | Hu | H05B 33/0845 |
| 2017/0303363 | A1 | 10/2017 | Pyshos et al. | |
| 2018/0035510 | A1 | 2/2018 | Doheny et al. | |
| 2018/0116029 | A1 | 4/2018 | Pyshos et al. | |
| 2018/0166026 | A1 | 6/2018 | Kumar et al. | |
| 2018/0310381 | A1 | 10/2018 | Bowen et al. | |
| 2018/0368232 | A1 | 12/2018 | Doheny et al. | |
| 2019/0027099 | A1 | 1/2019 | Kumar et al. | |
| 2019/0037663 | A1 | 1/2019 | Van Winkle | |
| 2019/0088213 | A1 | 3/2019 | Kumar et al. | |

FOREIGN PATENT DOCUMENTS

| | | |
|---|---|---|
| EP | 2728972 | 8/2015 |
| JP | 2011258517 | 12/2011 |
| WO | 2011084135 | 7/2011 |

OTHER PUBLICATIONS

U.S. Appl. No. 16/021,627, "Non Final Office Action," dated Aug. 29, 2018, 14 pages.

"2x4 LED Flat Panel", Main Place Lighting, Available Online at: https://shopmainplacelighting.com/collections/commercial-lighting/products/2-x-4-led-flat-panel-1, Accessed from Internet at May 14, 2019, 3 pages.

"38W LED Panel—Color Selectable", Venture Lighting, Available Online at: https://www.venturelighting.com/led-lighting/indoor-lighting-fixtures/panels-and-troffers/color-selectable-panels/standard-product/pn38592.html, Mar. 19, 2019, 9 pages.

"EASY Lighting Control", Application Guide, OSRAM, Available Online at: www.osram.com/easy, Apr. 2015, 25 pages.

"Human Centric Lighting", Helvar, Intelligent Colour Product Series, Brochure, Available Online at: https://www.helvar.com/media/filer_public/91/04/9104b3d6-392b-461a-aa48-dd073d33c76b/hcl_flyer-brochure.pdf, Dec. 4, 2017, 4 pages.

"iW Cove MX Powercore—Premium Interior Linear LED Cove and Accent Luminaire with Intelligent White Light", Philips Lighting, Product Family Leafelet, Nov. 20, 2017, 3 pages.

"LED Panel 1230 40W Colour Changeable", Fuzion Lighting, Information sheet, Available online at: http://www.fuzionlighting.com.au/product/led-panel-40-cct, Mar. 19, 2019, 6 pages.

"Noble Pro LED Line Voltage Task Lighting NLLP Series", AFX, R6/17, Ordering sheet, Available Online at: www.AFXinc.com, Accessed from Internet at May 13, 2019, 1 page.

"Par Lite Led", VanWhite, Coemar, User Manual Version 1.0, Jun. 2011, 19 pages.

"Viacon Led-Products", Venture Lighting, Available Online at: https://www.trilux.com/en/products/viacon-led/, Accessed from Internet at May 13, 2019, 11 pages.

* cited by examiner

LIGHTING SYSTEM WITH CONFIGURABLE DIMMING

TECHNICAL FIELD

This disclosure relates generally to lighting systems having groups of light-emitting diodes that can be configured to produce dimmable illumination. More specifically, but not by way of limitation, this disclosure relates to lighting systems in which a dimming curve of the illumination can be selectively modified.

BACKGROUND

Lighting systems include light-emitting diodes ("LEDs") that provide high-quality dimmable lighting with low power consumption and compact size. Light-emitting diodes can be driven by different drivers with different dimming curves. Thus, lighting fixtures, such as luminaires, are often manufactured in different configurations that provide different dimming curves that a customer can choose. But stocking LED-based fixtures to accommodate various desirable dimming curves can require maintaining a relatively large or cumbersome inventory.

SUMMARY

Certain aspects involve lighting systems in which the color temperature of the illumination can be selectively modified. For instance, a lighting system includes a light source configured for emitting light at a target color temperature and a switch configured to receive a selection of a dimming curve from a predefined set of dimming curves. When in a first position, the switch configures the light source to adjust a lumen intensity of the light source according to a dimming adjustment signal and a first dimming curve. When in a second position, the switch configures the light source to adjust the lumen intensity according to a dimming adjustment signal and a second dimming curve that is different from the first dimming curve.

In another example, a lighting driver is configured to receive one or more of a first signal indicating a selection of a first dimming curve from a predefined set of dimming curves or a second signal indicating a selection of a second dimming curve from the predefined set of dimming curves. The lighting driver is configured to receive a dimming adjustment signal. The lighting driver is further configured to provide an output current to a light source, the output current based on the selected dimming curve and the dimming adjustment signal.

These illustrative aspects are mentioned not to limit or define the disclosure, but to provide examples to aid understanding thereof. Additional aspects are discussed in the Detailed Description, and further description is provided there.

BRIEF DESCRIPTION OF THE DRAWINGS

Features, aspects, and advantages of the present disclosure are better understood when the following Detailed Description is read with reference to the accompanying drawings.

DETAILED DESCRIPTION

Aspects described herein involve lighting system that can be dimmed according to particular dimming curves, configured to operate at different color temperatures, or configured to operate at different intensities.

Certain aspects involve lighting systems that include one or more light sources (e.g., LED groups) for which an illumination dimming curve can be selectively modified. For instance, a luminaire can have multiple available dimming curves, such as linear, logarithmic, or square logarithmic. Among other uses, configurable dimming curves can allow for matching a dimming circuit to a particular type of LED driver or to user preferences.

In some aspects, a linear curve is used to provide an output voltage or current to a light source (and therefore the intensity of the light), which causes the output voltage or current to be modified linearly in relation to an adjustment of a control. For example, if an adjustment of a control is made by a first amount, then the output voltage or current is modified by a second amount that is proportional to the first amount. In additional or alternative aspects, an intensity of the light is modified using a logarithmic curve to provide the output voltage or current to a light source, which causes the output voltage or current to be modified logarithmically with respect to an adjustment of a control.

In some aspects, lighting systems can be configured to dim one or more light sources or to configure one or more light sources to emit light at a particular intensity. In other aspects, lighting systems can be dimmed using an external dimmer that alters an input voltage provided to the lighting system.

In some aspects, lighting systems can change an output color temperature. For example, a lighting system can include different light sources with different color temperatures. Alternatively, a lighting system can activate two or more light sources simultaneously to achieve a particular color temperature.

In further aspects, replacing light sources in an active light source combination can reduce costs or other resource expenditures for manufacturing a lighting system with a configurable dimming curve, color temperature, or intensity. In another example, a configurable microcontroller that permits dimming according to different dimming curves can reduce costs over a lighting system that includes multiple dimmers, each with a predetermined dimming curve.

Figure 1:
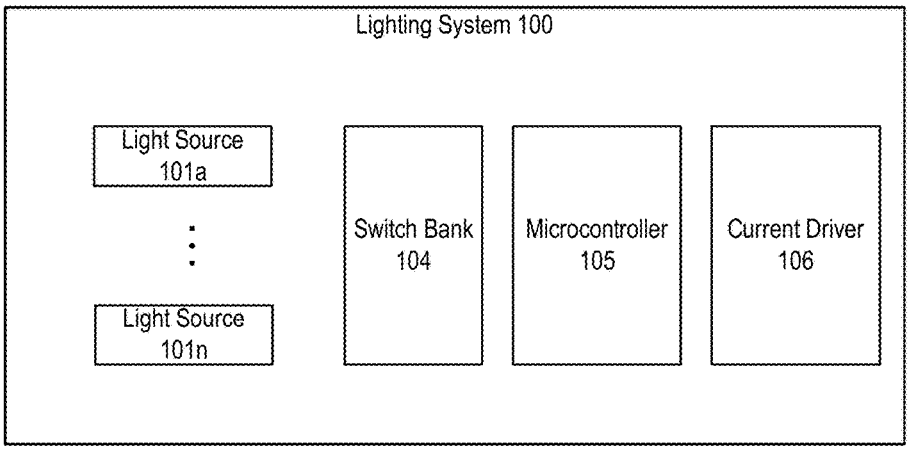
FIG. 1 depicts an example of a lighting system in which different light sources can be dimmed according to specific dimming curves, selectively activated to produce illumination having different color temperatures, or adjusted to produce different intensities of light, according to certain aspects of the present disclosure.

Referring now to the drawings, FIG. 1 depicts an example of a lighting system in which different light sources can be dimmed according to specific dimming curves, selectively activated to produce illumination having different color temperatures, or adjusted to produce different intensities of light, according to certain aspects of the present disclosure. The lighting system 100 can include one or more light sources 101*a-n*, a switch bank 104, microcontroller 105, or current driver 106.

A light source can include any device that can emit light, where light emitted at different color temperatures by different light sources can be combined to provide another color temperature. For illustrative purposes, certain examples described herein with respect to FIGS. 2-4 involve light sources that are LED groups. But other implementations are possible. Examples of a light source can include one or more LEDs, one or more halogen lighting devices, one or more incandescent lighting devices, one or more laser diodes, one or more organic light emitting diodes, and other light-emitting devices. The particular examples of light sources depicted and/or described herein with respect to FIGS. 2-4 can be replaced with one or more other light sources without departing from the scope of this disclosure.

Each LED group 101*a-n* can include one or more LEDs in any configuration such as series or parallel. Using switch bank 104, each LED group 101*a-n* can be configured for a different dimming curve, light intensity, or color temperature. Individual LED groups 101*a-n* can be configured separately. For example, LED group 101*a* can be configured, via switch bank 104, to dim using a linear curve, whereas LED group 101*b* can be configured to dim via a logarithmic curve. Similarly, LED group 101*a* can be configured, via switch bank 104, to output light at a first intensity whereas LED group 101*b* can be configured to output light at a second intensity. Two or more LED groups 101*a-n* can be configured together. For example, LED group 101*a* and LED group 101*b* can be dimmed using the same dimming curve. In this manner, a higher lumen output is possible than activating or dimming one LED group alone.

Switch bank 104 can include any device having one or more switches that provide one or more signals to microcontroller 105. The provided signal can cause microcontroller 105 to adjust different parameters such as a dimming curve, intensity, or color temperature of one or more LED groups 101*a-n*. Microcontroller 105 can receive one or more signals from switch bank 104. Microcontroller 105 can determine the desired configuration of dimming curve, color temperature, or intensity based on the one or more signals. Microcontroller 105 can cause an appropriate amount of current to one or more LED groups 101*a-n* according to a dimming level and dimming curve.

The switches included in switch bank 104 can be assigned into groups, where the group assignments can be modifiable, in order to provide additional combinations parameters. For example, if one switch is used to control dimming curve, then two dimming curves are possible (e.g., one curve corresponding to the OFF position and another corresponding to the ON position). Additionally, one or more switches can be used for each parameter. For example, the configuration of a dimming curve can be accomplished with two switches, providing a total of four different dimming curves. Different switch configurations of switch bank 104 are discussed further with respect to FIG. 3.

As used herein, a "switching device," or a "switch," can include any mechanism, device, or group of devices that can have different configurations that change one or more connections in one or more electrical circuits of a lighting system. For illustrative purposes, certain examples described herein with respect to FIGS. 2-5 involve switches with one or more throws and poles, slide switches, transistors, etc. But any suitable implementation involving a mechanism, device, or group of devices that change one or more connections in one or more electrical circuits of a lighting system can be used. The particular examples of switching devices depicted and/or described herein with respect to FIGS. 2-5 can be replaced with one or more other switching devices without departing from the scope of this disclosure. Examples of switching devices include DIP switches, slider switches, factory-configured switches, toggles, rotary dials, transistor-based switches, circuit-based switches, etc.

The lighting system 100 can also include microcontroller 105. Microcontroller 105 can be any processor or controller. An example of a microcontroller 105 an ARM or x86-based microcontroller, an application-specific integrated circuit ("ASIC"), a field-programmable gate array ("FPGA"), or any other suitable processing device. The microcontroller can be communicatively coupled to one or more memory devices (not depicted). A memory device includes any suitable non-transitory computer-readable medium for storing program code, program data, or both. The memory device can be non-volatile memory such as ROM or Flash.

The microcontroller can execute program code that configures the microcontroller to perform one or more of the operations described herein. Examples of the program code include, in various aspects, modeling or control algorithms, or other suitable applications that perform one or more operations described herein. A computer-readable medium can include any electronic, optical, magnetic, or other storage device capable of providing a processor with computer-readable instructions or other program code. Non-limiting examples of a computer-readable medium include a magnetic disk, a memory chip, a ROM, a RAM, an ASIC, optical storage, magnetic tape or other magnetic storage, or any other medium from which a processing device can read instructions. The instructions may include processor-specific instructions generated by a compiler or an interpreter from code written in any suitable computer-programming language, including, for example, C, C++, C#, Visual Basic, Java, Python, Perl, JavaScript, and ActionScript. Program data that can include one or more datasets and models described herein. Examples of these datasets include dimming curves, intensity levels, or data described in Tables 1-3.

In an aspect, the functionality of microcontroller 105 can be implemented by an electronic circuit such as an analog circuit. For example, a set of switches and analog components can implement lookup table functionality performed by microcontroller 105.

In a further aspect, the microcontroller 105 or functionality thereof can be incorporated into the driver. For example, a current driver can include a microcontroller that receives an input selecting a dimming curve. The microcontroller can cause the current driver to adjust the current flowing through a lighting source according to the dimming curve and a dimming adjustment signal, thereby adjusting the intensity of the lighting source.

In yet another aspect, the microcontroller 105 can receive the dimming adjustment signal. The dimming adjustment signal can be an analog signal such as a variable voltage. For example, a higher voltage can indicate brighter light and a lower voltage can indicate dimmer light. The dimming adjustment signal can also be a digital signal. For example, microcontroller 105 can receive a selection of a discrete set of output levels. Microcontroller 105 can access a table that includes a set of entries that each match a digital input signal to a particular lumen intensity. The dimming adjustment signal can also be a wireless signal. For example, microcontroller 105 can connect to a wireless transceiver, which in turn can connect to an antenna. A remote device such as a remote control can transmit a signal corresponding to a desired lumen intensity to the wireless transceiver, which can decode the signal, and provide the signal to microcontroller 105.

The lighting system 100 can also include a current driver 106. Current driver 106 can provide a regulated voltage for the LED groups. For example, current driver 106 receives an input voltage from a power source and steps the voltage down as appropriate for the LED groups. Microcontroller 105 can cause current to flow by opening a transistor-based switch or inputting a signal into current driver 106.

Figure 2:
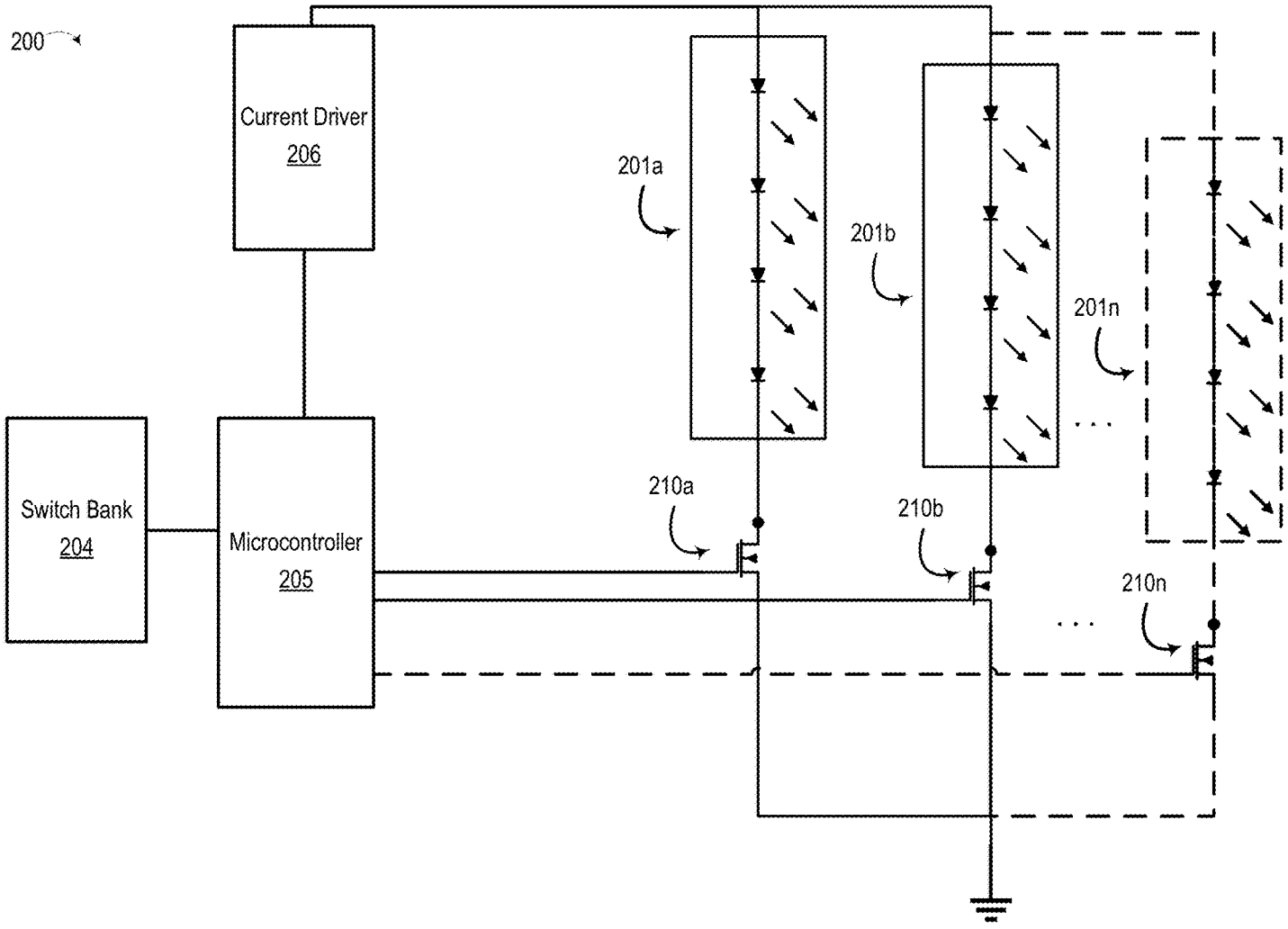
FIG. 2 depicts an example of an implementation of the lighting system from FIG. 1 that includes two different LED groups, according to certain aspects of the present disclosure.

FIG. 2 depicts an example of an implementation of the lighting system 100 that includes two different LED groups, according to certain aspects of the present disclosure. In FIG. 2, the lighting system 200, which an example of implementing the lighting system 100, includes LED groups 201*a-n*, switch bank 204, microcontroller 205, current driver 206, and one or more transistors 210*a-n*.

In the example depicted, LED group 201*a*, LED group 201*b*, and LED group 201*n*, are shown. But any number of LED groups are possible. Each LED group can include one or more LEDs configured to operate at a particular color temperature. Each LED 201*a-n* group can be configured differently via switch bank 204. LED groups 201*a-n* are examples of "lighting sources X-Y from FIG. 1, though other types of light sources can be used.

Switch bank 204 includes one or more switching devices for configuring one or more of a dimming curve, a color temperature, and an intensity. The configuration of the switches causes signals to configure the microcontroller, when power is added to lighting system 200, to operate LED groups 201*a-n* in accordance with the selected configuration.

Transistors 210*a-n* are controlled by the microcontroller 205 to switch one or more LED groups 201*a-n* on or off. For example, transistor 210*a*, when activated, causes current to flow from the current driver 206 through LED group 201*a*. Similarly, transistor 210*b*, when activated, causes current to flow from the current driver 206 through LED group 201*b*. As depicted, based on the configuration of the switch bank 204, microcontroller 205 outputs signals, e.g., small amounts of power, to the appropriate transistor 210*a-n*.

Different LED groups can be configured to operate with different dimming curves, color temperatures, or intensity levels. For example, different LED groups can be configured to operate at different color temperatures. For example, LED group 201*a* can be configured to emit soft light at 2700° Kelvin, whereas LED group 201*b* can be configured to operate at 3500° Kelvin.

In an example, a professional installer, store clerk, manufacturing system, technician, or user can configure the switches in switch bank 204 such that the microcontroller 205 causes one or more of LED groups 201*a-n* to operate with a particular dimming curve, intensity level, or color temperature. For example, a professional installer may configure lighting system 200 to operate with a linear dimming curve, then install the lighting system in a customer's premises. Similarly, a professional installer may configure another lighting system 200 with a higher intensity and install the lighting system in the customer's basement, where more light is desired.

Figure 3:
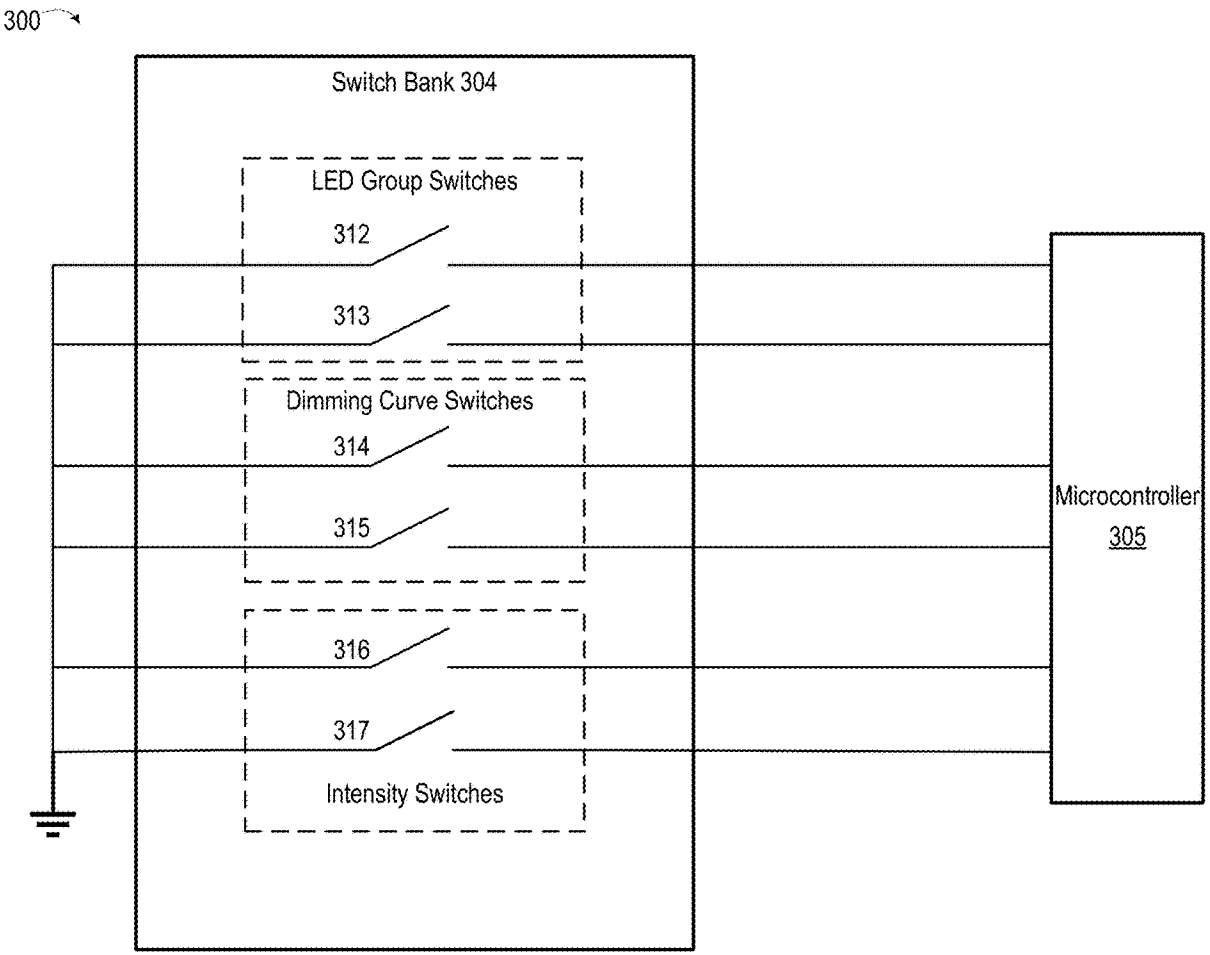
FIG. 3 depicts an example of a set of switches that can be used to configure output current, dimming curve, or an output power routing in the lighting system of FIG. 1 or FIG. 2, according to certain aspects of the present disclosure.

FIG. 3 depicts an example of a set of switches that can be used to configure one or more of an output current, a dimming curve, or an output power routing, according to certain aspects of the present disclosure. FIG. 3 depicts configuration environment 300, which includes switch bank 301 and microcontroller 305. Switch bank 304 is an example of an implementation of switch banks 104 or 204. Switch bank 301 includes LED group switches 312 and 313, dimming curve switches 314 and 315, and intensity switches 316 and 317. Each switch 312-317 can be in one of two positions (e.g., ON or OFF). Two-position switches are shown for illustrative purposes, but different kinds of switches, rotary dials, or other mechanisms can be used to create signals to indicate a particular configuration to the microcontroller 305.

Tables 1-3, shown below, illustrate examples of switch-to-microcontroller configuration mappings for switches 312-313, 314-315, and 316-317 respectively. Adjustments can be made to one or more of color temperature, dimming curve, and intensity.

In some aspects, LED group switches 312 and 313 can determine which group of LEDs are activated. As shown in the example from Table 1 below, the position of LED group switch 312 and the position of LED group switch 313 together determine the configuration of microcontroller 305. The configuration of microcontroller 305, when the lighting system is activated with power, causes the output power to be connected to one or more of the LED groups 201*a-d*. For example, if LED group switches 312 and 313 are both set to the "ON" position, then the output power is routed to LED group 201*a*. In additional or alternative aspects, different configurations are possible in which output power is routed to two or more LED groups 201*a-n*.

TABLE 1

| Output Power Routing (LED Group Selection) | | |
|---|---|---|
| LED Group Switch 312 Position | LED Group Switch 313 Position | Output Power Routing |
| ON | ON | 201a |
| ON | OFF | 201b |
| OFF | ON | 201c |
| OFF | OFF | 201d |

In additional or alternative aspects, dimming curve switches 314 and 315 configure microcontroller 305 to use a specific dimming curve if dimming one or more LED groups 201*a-n*. As shown in the example from Table 2 below, the combination of dimming curve switch 314 position and dimming curve switch 315 position determines a dimming curve from four predetermined dimming curves. Dimming curves 1-4 can be selected from linear, logarithmic, square logarithmic, or other curves. For example, if dimming curve switch 314 is set to OFF and dimming curve switch 315 is set to ON, then dimming curve 3 is selected.

TABLE 2

| Dimming Curve | | |
|---|---|---|
| Dimming Curve Switch 314 Position | Dimming Curve Switch 315 Position | Dimming Curve |
| ON | ON | Dimming Curve 1 |
| ON | OFF | Dimming Curve 2 |
| OFF | ON | Dimming Curve 3 |
| OFF | OFF | Dimming Curve 4 |

In additional or alternative aspects, intensity switches 316 and 317 together determine the output current, and therefore the intensity, of one or more LED groups 201*a-n*. As shown in the example from Table 3 below, the combination of the positions of switch 316 and 317 determine one of four predetermined output current levels. For example, current levels 1-4 can correspond to 5 mA, 10 mA, 15 mA, and 20 mA. For example, if intensity switch 316 and intensity switch 317 are both OFF, then microcontroller 305 selects current level 4. Microcontroller 305 causes, when power is provided to the lighting system, an amount of current corresponding to current level 4 to be provided to one or more LED groups such as the LED groups selected using LED group switches 312 and 313 above. The output current can be further adjusted based on the selected dimming curve, as described with respect to dimming curve switches 314 and 315 and Table 2.

TABLE 3

| Output Current (Intensity) | | |
|---|---|---|
| Intensity Switch 316 Position | Intensity Switch 317 Position | Output Current |
| ON | ON | Current level 1 |
| ON | OFF | Current level 2 |
| OFF | ON | Current level 3 |
| OFF | OFF | Current level 4 |

In another configuration (not shown), additional switches are present to allow additional control of LED groups 201*a-n*, such as separate configuration of color temperature, dimming curve, and intensity of each of the LED groups 201*a-n*. For example, dimming curve 1 can be applied with current level 3 to LED group 201*d*, and so on. Each set of switches can come pre-configured at the factory or be changed by an installer or professional.

Microcontroller 305 can maintain the switch configurations, depicted in Tables 1, 2, and 3 in a data structure stored in non-volatile memory. Each time the microcontroller powers on, the microcontroller can check the switch inputs from switches 312-317 against entries in Tables 1-3 in order to determine the correct configuration of LED group, dimming curve, and intensity level.

Figure 4:
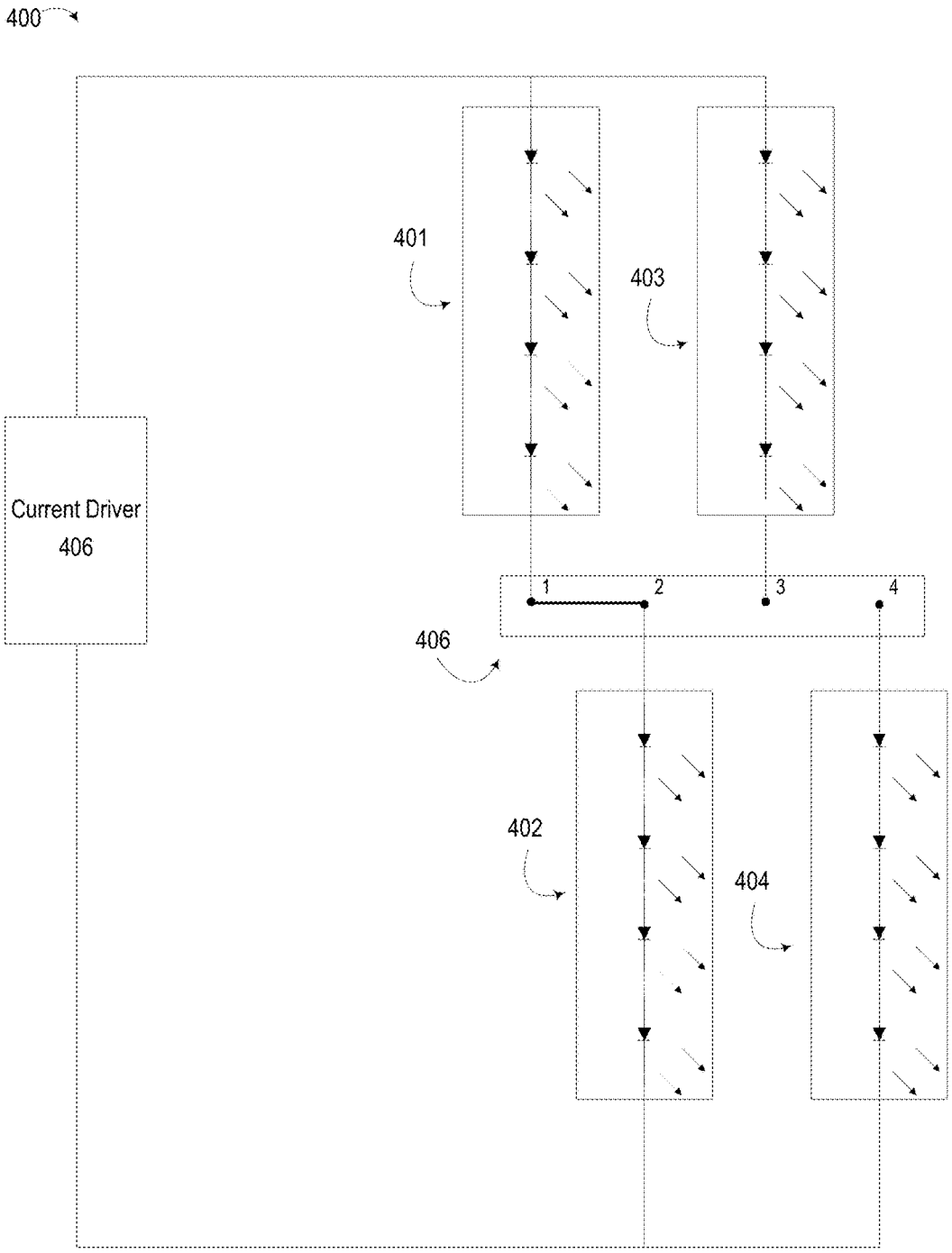
FIG. 4 depicts a lighting system in which different light sources can be dimmed according to specific dimming curves and in which the emitted light can be configured to be specific color temperatures, according to certain aspects of the present disclosure.

FIG. 4 depicts a lighting system in which different light sources can be dimmed according to specific dimming curves and in which the emitted light can be configured to be specific color temperatures, according to certain aspects of the present disclosure. FIG. 4 depicts a lighting system 400 that is an example of implementing the lighting system 100.

Lighting system 400 can include LED groups 401-404. The lighting system 400 can also include an additional switch 406 that can selectively connect different combinations of the LED groups 401, 402, 403, 404. The additional switch 406 can selectively connect different light-source combinations to a current driver 405. In some aspects, the current driver 405 can be a constant current driver.

Lighting system 400 can provide the selectable dimming curve functionality of lighting system 200 combined with additional color temperature selection functionality, for example, by incorporating microcontroller 205 and switches 201*a-c*. In this manner, with additional switch 406 and switches 201*a-c*, lighting system 400 can provide configurable color temperature and dimming curve functionality.

In the example depicted in FIG. 4, the switch 405 has a configuration that activates a first light-source combination. The first light-source combination can include the LED groups 401 and 402 connected in series. The additional switch 406 can have a position or other configuration in which an open path exists between the LED group 403 and the current driver 405, an open path exists between the LED group 404 and the current driver 405, and a closed path includes the LED group 401, the LED group 402, and the current driver 405.

In the examples depicted in FIG. 4, the different light-source combinations can cause the lighting system 200 to emit light at different color temperatures, respectively. Table 4 provides an example of the total combined color temperature ("CCT"), in degrees Kelvin, for each of the different switch configurations.

In a second configuration, additional switch 406 is at a second position providing an alternative combination of LED groups. Changing the additional switch 406 from a first position to a second position can cause the LED group 401 to be replaced with the LED group 403. In this example, the light-source combination can include the LED groups 402 and 403 connected in series. The additional switch 406 can have a position or other configuration in which an open path exists between the LED group 401 and the current driver 405, an open path exists between the LED group 404 and the current driver 405, and a closed path includes the LED group 402, the LED group 403, and the current driver 405.

In a third configuration, the additional switch 406 is at a third position providing another alternative combination of LED groups. Changing the additional switch 406 from a second position to a third position can cause the LED group 402 to be replaced with the LED group 404. In this example, the light-source combination includes the LED groups 403 and 404 connected in series. The additional switch 406 can have a position or other configuration in which an open path exists between the LED group 401 and the current driver 405, an open path exists between the LED group 402 and the current driver 405, and a closed path includes the LED group 403, the LED group 404, and the current driver 405.

TABLE 4

| Switch position | LED Group 401 (3000K) | LED Group 402 (3000K) | LED Group 403 (4000K) | LED Group 404 (4000K) | Total CCT |
|---|---|---|---|---|---|
| 1 (LED groups 201 and 202 connected) | ON | ON | OFF | OFF | 3000K |
| 2 (LED groups 202 and 203 connected) | OFF | ON | ON | OFF | 3500K |
| 3 (LED groups 203 and 204 connected) | OFF | OFF | ON | ON | 4000K |

Figure 5:
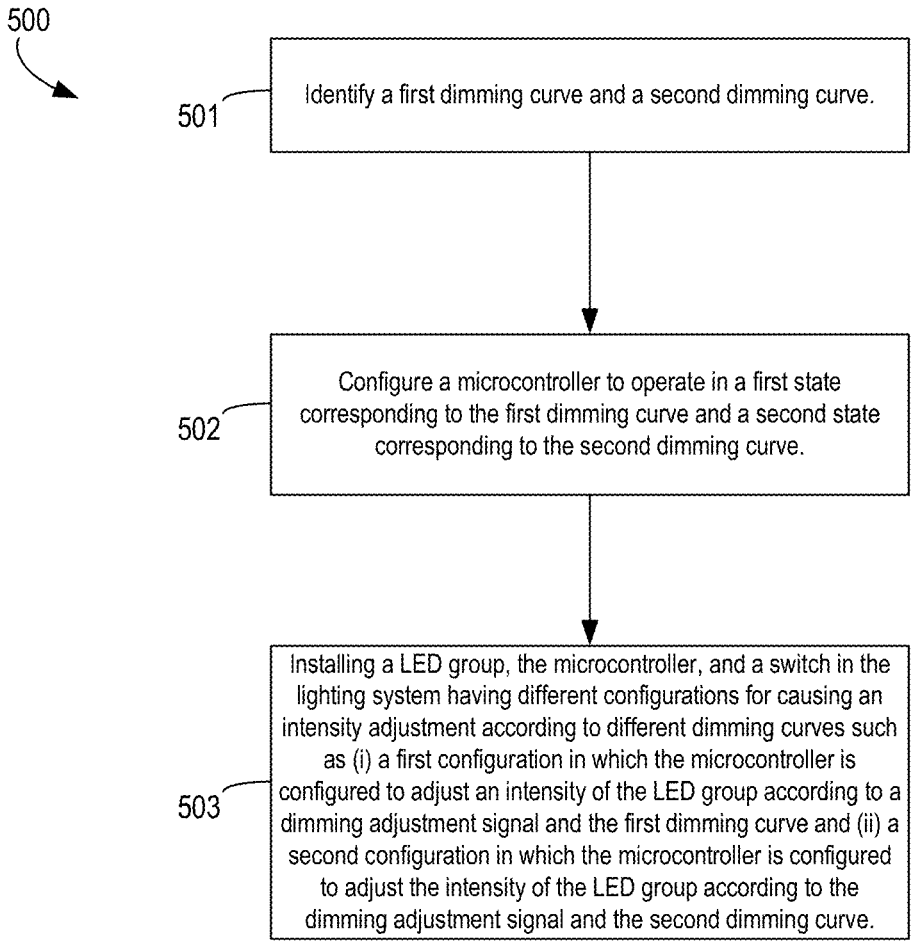
FIG. 5 depicts an example of a method for manufacturing one or more lighting systems in which different LED groups can be dimmed according to different diming curves.

FIG. 5 depicts an example of a method 500 for manufacturing one or more lighting systems in which different LED groups can be dimmed according to different diming curves. Method 500 can be used to manufacture one or more of the lighting systems 100, 200, as well as variants thereof. For illustrative purposes, the method 500 is described with respect to the examples depicted in FIGS. 1-4. But other implementations are possible.

At block 501, method 500 involves identifying a first dimming curve and a second dimming curve. In some aspects, identifying these values can involve accessing these values from files. In one example, a computing device executing suitable design software can access specification data from one or more files stored in a non-transitory computer-readable medium. In another example, a technician, can access specification data from one or more files.

The files can include specifications for a luminaire or other lighting system. The specification data can include, for example, one or more dimming curves. The specification data can include additional parameters such as target lumen output, a first color temperature, and a second color temperature. In some aspects, the specification data can include a threshold tolerance with respect to the dimming curves. The computing device can identify the dimming curves from the specification data. In some aspects, a technician can perform one or more of these operations.

At block 502, method 500 involves configuring a microcontroller to operate in a first state corresponding to the first dimming curve and a second state corresponding to the second dimming curve. For example, the computing device can access the schematic diagram that includes a particular configuration of switches necessary for a particular dimming curve, lumen output, LED group configuration, or color temperature such as those depicted Tables 1-4. From the configuration, the computing device can configure a set of switches, or make the appropriate connections such that the microcontroller is appropriately configured.

At block 503, method 500 involves installing a LED group, the microcontroller, and a switch in the lighting system, with switch having different configurations for causing an intensity adjustment according to different dimming curves. For example, the switch can have a first configuration in which the microcontroller is configured to adjust an intensity of the LED group according to a dimming adjustment signal and the first dimming curve. The switch can also have a second configuration in which the microcontroller is configured to adjust the intensity of the LED group according to the dimming adjustment signal and the second dimming curve. In some aspects, the computing device can output a schematic diagram or other data that includes circuits (e.g., one or more of the circuits depicted in FIGS. 1 and 2) that include one or more LED groups, a switch bank, and a microcontroller.

In some aspects, the outputted schematic diagram or other data can be provided (e.g., by the computing device or via a transfer on a non-transitory computer-readable medium) to one or more manufacturing systems. A manufacturing system assemble one or more LED groups, a switch bank, a microcontroller, and associated circuitry into the lighting system. For example, the manufacturing system can position one or more of the LED groups, position one or more switches, position a microcontroller, and connect the LED groups, switches, and microcontroller to a wiring system (e.g., a printed circuit board or other set of conductors) that implements the outputted schematic diagram or other data.

In additional or alternative aspects, the outputted schematic diagram or other data can be provided (e.g., by the computing device or via a transfer on a non-transitory computer-readable medium) to one or more technicians. The technician can manually assemble the LED groups, the switch bank, and the microcontroller into the lighting system. For instance, the technician can position one or more of the LED groups, position one or more switches, position the microcontroller, and connect the LED groups and switches to a wiring system that implements the outputted schematic diagram or other data.

In some aspects, installing the first LED group, the second LED group, and the third LED group with the switch involves implementing the lighting system 200. For instance, a manufacturing system or technician could position one or more switches between the first LED group and the second LED group in a first path that includes a current driver. A manufacturing system or technician could also position one or more switches between the first LED group and the third LED group in a second path that includes the current driver. The switch could be a slide switch, as described above with respect to FIGS. 2-4. The slide switch could have a first position that implements the first configuration and a second position that implements the second configuration.

General Considerations

Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter.

Unless specifically stated otherwise, it is appreciated that throughout this specification discussions utilizing terms such as "computing," "determining," and "identifying" or the like refer to actions or processes of a computing device, such as one or more computers or a similar electronic computing device or devices, that manipulate or transform data represented as physical electronic or magnetic quantities within memories, registers, or other information storage devices, transmission devices, or display devices of the computing platform.

The system or systems discussed herein are not limited to any particular hardware architecture or configuration. A computing device can include any suitable arrangement of components that provide a result conditioned on one or more inputs. Suitable computing devices include multi-purpose microprocessor-based computer systems accessing stored software that programs or configures the computing system from a general purpose computing apparatus to a specialized computing apparatus implementing one or more aspects of the present subject matter. Any suitable programming, scripting, or other type of language or combinations of languages may be used to implement the teachings contained herein in software to be used in programming or configuring a computing device.

Aspects of the methods disclosed herein may be performed in the operation of such computing devices. The order of the blocks presented in the examples above can be varied—for example, blocks can be re-ordered, combined, and/or broken into sub-blocks. Certain blocks or processes can be performed in parallel.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

The foregoing description, including illustrated examples, has been presented only for the purpose of illustration and description and is not intended to be exhaustive or to limit the invention to the precise forms disclosed. Numerous modifications, adaptations, and uses thereof will be apparent to those skilled in the art without departing from the scope of this disclosure. Aspects and features from each example disclosed can be combined with any other example.

The invention claimed is:

1. A lighting system comprising:

a light source configured for emitting light at a target color temperature; and a switch configured to receive a selection of a dimming curve from a predefined set of dimming curves, wherein when in a first position, the switch configures the light source to adjust a lumen intensity of the light source according to a dimming adjustment signal and a first dimming curve, and when in a second position, the switch configures the light source to adjust the lumen intensity according to the dimming adjustment signal and a second dimming curve that is different from the first dimming curve.

2. The lighting system of claim 1 further comprising a microcontroller configured to:

receive the selection of the dimming curve from the switch; and configure the light source to dim according to the first dimming curve or the second dimming curve.

3. The lighting system of claim 2, wherein the dimming adjustment signal is one or more of (i) a voltage level input to the lighting system, (ii) a digital signal input, and (iii) a wireless input signal.

4. The lighting system of claim 1, further comprising a microcontroller configured to:

identify a signal generated by the switch;

access a table entry from a data table, the table entry comprising a mapping between the signal and an additional dimming curve from a predefined set of dimming curves; and dim the light source according to the additional dimming curve indicated by the table entry.

5. The lighting system of claim 1, wherein the light source is a Light Emitting Diode (LED) group.

6. The lighting system of claim 1, further comprising an additional switch configured to generate the dimming adjustment signal.

7. The lighting system of claim 1, further comprising an additional switch having a first configuration selecting a first intensity and a second configuration selecting a second intensity.

8. The lighting system of claim 1, further comprising an additional switch having a first configuration selecting a first color temperature and a second configuration selecting a second color temperature.

9. The lighting system of claim 1, wherein the predefined set of dimming curves comprises a linear curve, a logarithmic curve, or a square logarithmic curve.

10. The lighting system of claim 1, further comprising an additional switch having a first configuration selecting the light source and a second configuration selecting an additional light source, wherein the light source is configured to emit a first color temperature of light and the additional light source is configured to emit a second color temperature of light.

11. A lighting driver comprising:

a dimming adjustment input port;

a dimming curve input port; and an output port, wherein:

the dimming curve input port is configured to receive a dimming curve selection from a predefined set of dimming curves, the dimming curve selection indicated by one or more of (i) a first signal indicating a first selection of a first dimming curve from the predefined set of dimming curves or (ii) a second signal indicating a second selection of a second dimming curve from the predefined set of dimming curves, the dimming adjustment input port is configured to receive a dimming adjustment signal, and the lighting driver is configured to provide an output current via the output port to a light source, the output current based on the dimming curve selection and the dimming adjustment signal.

12. The lighting driver of claim 11, wherein the dimming adjustment signal is one or more of (i) a voltage level input, (ii) a digital signal, and (iii) a wireless signal.

13. The lighting driver of claim 11, further comprising a microcontroller configured to:

access, from a table, a table entry comprising a mapping between the dimming curve selection and a dimming curve from a predefined set of dimming curves; and dim the light source according to the dimming curve indicated by the table entry.

14. The lighting driver of claim 11, wherein the lighting driver further comprises an additional input port configured to receive an additional input indicating a first intensity or a second intensity, wherein the lighting driver is configured to adjust the output current to configure an intensity of the light source to either the first intensity or the second intensity.

15. The lighting driver of claim 11, wherein the lighting driver further comprises an additional input port that is configured to detect an additional input from an additional switch having (i) a first configuration selecting a first color temperature and (ii) a second configuration selecting a second color temperature, wherein the lighting driver is configured to set a color temperature of the light source to either the first color temperature or the second color temperature.

16. The lighting driver of claim 11, wherein the predefined set of dimming curves comprises one or more of a linear curve, a logarithmic curve, and a square logarithmic curve.

17. A method of manufacturing a lighting system, the method comprising:

identifying a first dimming curve and a second dimming curve;

configuring a microcontroller to operate in a first state corresponding to the first dimming curve and a second state corresponding to the second dimming curve; and installing a light source, the microcontroller, and a switch in a lighting system, the switch having (i) a first configuration in which the microcontroller is configured to adjust an intensity of the light source according to a dimming adjustment signal and the first dimming curve and (ii) a second configuration in which the microcontroller is configured to adjust the intensity of the light source according to the dimming adjustment signal and the second dimming curve.

18. The method of claim 17, wherein the switch is a slide switch having a first position that implements the first configuration and having a second position that implements the second configuration.

19. The method of claim 17, wherein the first dimming curve and the second dimming curve comprise (i) a linear curve, (ii) a logarithmic curve, or (iii) a square logarithmic curve.

20. The method of claim 17, further comprising:

configuring the microcontroller to operate in a first intensity state corresponding to a first intensity and a second intensity state corresponding to the second dimming curve; and installing a light source, the microcontroller, and the switch in the lighting system, the switch having (i) a first intensity configuration in which the microcontroller is configured to set the intensity of the light source according to a first predetermined intensity and (ii) a second intensity configuration in which the microcontroller is configured set the intensity of the light source according to a second intensity.

* * * * *